United States Patent [19]

Orova et al.

[11] 4,385,601

[45] May 31, 1983

[54] SYSTEM FOR LIMITING THE SPEED OF INTERNAL COMBUSTION ENGINE HAVING AN IGNITION SYSTEM UTILIZING A MAGNETO GENERATOR

[75] Inventors: Josef Orova, Schwabach; Jiri Podrapsky, Rosstal, both of Fed. Rep. of Germany

[73] Assignee: Robert Bosch GmbH, Stuttgart, Fed. Rep. of Germany

[21] Appl. No.: 269,346

[22] Filed: Jun. 1, 1981

[30] Foreign Application Priority Data

Jul. 30, 1980 [DE] Fed. Rep. of Germany ..... 3028907

[51] Int. Cl.[3] ..... F02P 5/04; F02P 3/04; F02P 1/00

[52] U.S. Cl. ..... 123/335; 123/315; 123/418; 123/334

[58] Field of Search ..... 123/418, 335, 630, 334, 123/340, 351, 599

[56] References Cited

U.S. PATENT DOCUMENTS

| | | | |
|---|---|---|---|
| 4,010,726 | 3/1977 | Kondo et al. | 123/599 |
| 4,144,859 | 3/1979 | Ohki et al. | 123/335 |
| 4,150,652 | 4/1979 | Nagasawa | 123/599 |
| 4,175,509 | 11/1979 | Orova et al. | 123/418 |
| 4,178,892 | 12/1979 | Podrapsky et al. | 123/418 |
| 4,188,929 | 2/1980 | Podrapsky et al. | 123/418 |
| 4,204,490 | 5/1980 | Ohki et al. | 123/335 |
| 4,237,835 | 12/1980 | Rabus et al. | 123/418 |
| 4,282,839 | 8/1981 | Newberry et al. | 123/335 |
| 4,321,901 | 3/1982 | Kobayashi et al. | 123/351 |
| 4,335,692 | 6/1982 | Miura | 123/418 |

*Primary Examiner*—Raymond A. Nelli

*Attorney, Agent, or Firm*—Frishauf, Holtz, Goodman & Woodward

[57] ABSTRACT

Speed limiting in an ignition system utilizing a magneto generator is accomplished by increasing the damping of the half wave not utilized for ignition. This is accomplished by switching in additional resistance in parallel with the damping circuit resistance when the speed of the engine exceeds the speed to which it is to be limited. The additional damping during the half wave which is not utilized causes a decrease in the current and voltage wave utilized for ignition because of armature reaction. The decrease, in turn, causes a sudden change in ignition timing in the direction of late ignition and therefore an additional damping or complete suppression of ignition.

8 Claims, 3 Drawing Figures

SYSTEM FOR LIMITING THE SPEED OF INTERNAL COMBUSTION ENGINE HAVING AN IGNITION SYSTEM UTILIZING A MAGNETO GENERATOR

CROSS-REFERENCE TO RELATED PUBLICATIONS

German Published Application DE-OS No. 2 405 382.

The present invention relates to speed limiting devices in internal combustion engines wherein a magneto generator is utilized to create the requisite ignition energy.

BACKGROUND AND PRIOR ART

In presently known equipment of this type, the armature of the magneto generator also constitutes the ignition coil. The primary winding of the ignition coil is short-circuited by the emitter-collector circuit of a transistor connected in a Darlington configuration until the ignition time. Because of this short-circuit, the voltage in the primary circuit has a very small amplitude and is almost in phase with the primary current. To initiate ignition, a threshold circuit is used which, when a predetermined threshold voltage is exceeded in the primary circuit, generates a signal blocking the above-mentioned transistor. The magnet wheel of the magneto generator generates both positive and negative half waves in the primary circuit. If the negative half wave is not utilized for ignition, it is damped by a damping circuit so that the no-load voltages in the primary circuit cannot reach too high a value. It is the disadvantage of these known ignition systems that no speed limiting is provided, so that high speed tools such as, for example, saws or grinders may be destroyed by excessive speed.

In German published application No. 2 405 382 a speed limiting circuit is disclosed which, when the maximum speed of the internal combustion engine is passed, causes the ignition transistor to be short-circuited during the positive half wave, that is the half wave which is utilized for ignition. This type of speed limiting has the disadvantage that ignition is abruptly switched on and off. This can cause undesired sparks to be generated in the crank shaft housing and in the exhaust system, thereby causing the internal combustion engine to be destroyed. Further, the power of the engine is abruptly switched in and out, which may lead to undesired oscillations.

THE INVENTION

It is an object of the present invention to furnish a system wherein a soft, i.e. gradual, load limiting takes place when the speed of the internal combustion engine exceeds the maximum allowable speed. In particular, the speed limiting is to be achieved by causing the ignition timing to be retarded by a predetermined amount when the engine speed exceeds the above-mentioned maximum allowable speed.

It is a further object of the invention to furnish a system wherein the amount of retardation of the ignition timing which takes place abruptly when the engine speed exceeds the maximum allowable speed can be matched readily to the characteristics of the particular engine.

In accordance with the invention, a speed dependent circuit is connected to the damping circuit which is already present in the circuit and which dampens the circuit during the half wave which is not used for ignition.

More specifically, a thyristor which is part of a thyristor-resistor series circuit is switched to the conducting state by the output of a differentiating circuit. The differentiating circuit furnishes the control signal for the thyristor when the rate of change of the half wave not used for ignition exceeds a predetermined rate of change indicative of the excess speed. The resistance of a resistor in series with the thyristor then determines the amount of ignition timing retardation. It is thus to be noted that no additional speed sensor is required for the system.

In the particularly preferred embodiment, a voltage limiter is connected in parallel with the differentiating circuit so that the thyristor is switched to the conductive state for the same rate of change of AC signal independent of the mechanical and magnetic tolerances of the magneto generator.

DESCRIPTION OF THE PREFERRED EMBODIMENT

Figure 1:
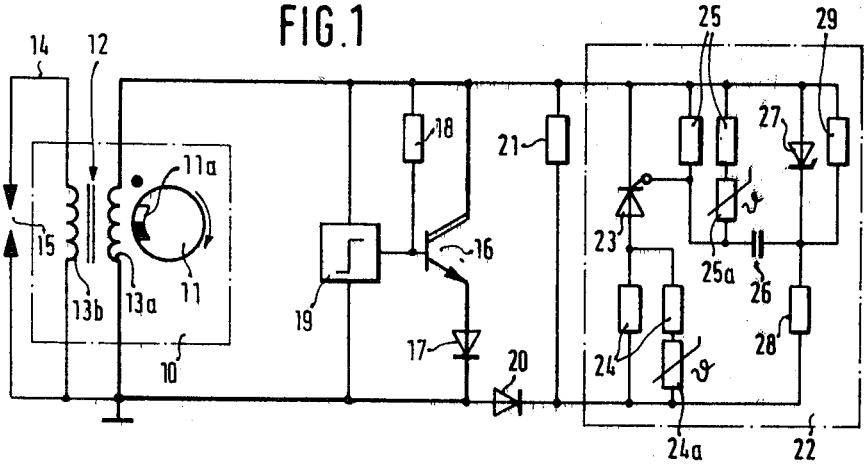
FIG. 1 is a schematic circuit diagram of an ignition circuit with the speed limiting circuit of the present invention.

The ignition system for a single cylinder internal combustion engine is shown in FIG. 1. This includes a magneto generator 10. Magneto generator 10 consists of a rotating magnetic system 11 which has a permanent magnet 11*a* arranged between two pole shoes at the outer periphery of a fan or flywheel driven by the internal combustion engine. Rotating permanent magnet 11*a* cooperates with an armature 12 which is fastened to the housing of the internal combustion engine. Armature 12 also acts as an ignition coil and has a primary winding 13*a* and a secondary winding 13*b*. The secondary winding is connected through an ignition cable 14 to the spark plug 15 of the internal combustion engine. The output circuit of an npn transistor 16 is connected to primary winding 13*a* of ignition coil 12. Transistor 16 is connected in a Darlington circuit configuration. Its collector is connected to one end of primary winding 13*a*, while its emitter is connected through a diode 17 to the grounded end of primary winding 13*a*. Diode 17 protects against inverse current and is therefore connected to conduct current in the same direction as the output circuit of transistor 16. The base of transistor 16 is connected to its collector through a resistor 18. Further, the base is connected to the output of a control circuit 19. The input to control circuit 19 is connected in parallel with primary winding 13*a* of ignition coil 12. Control circuit 19 includes a threshold circuit which furnishes a signal for blocking transistor 16 as soon as the voltage in the primary circuit exceeds a predetermined voltage. Further, a damping circuit for damping the negative voltage half waves in the primary circuit is connected in parallel to primary winding 13*a*. It will be noted that the negative voltage half waves are not required for ignition in this particular embodiment. The damping circuit consists of a diode 20 and a resistor 21 connected in series with the diode. Diode 20 is so poled that it is conductive only during the negative voltage half waves in the primary circuit.

A speed-dependent circuit 22 is connected in parallel to resistor 21 of the damping circuit. The speed-dependent circuit is switched from a blocked to a conductive state when the speed of the internal combustion engine exceeds a maximum allowable speed. Speed-dependent circuit 22 consists mainly of a thyristor 23 connected in series with a damping resistor 24. The control electrode of thyristor 23 is connected to a differentiating circuit, here a series RC circuit 25,26. The tap between resistor 25 and capacitor 26 of the RC circuit is connected to the control electrode of thyristor 23. The resistor 25 of the RC circuit is therefore connected in parallel with the control circuit of thyristor 23. The series RC circuit 25,26 is also connected in parallel to a voltage limiting element, for example a Zener diode 27. A series circuit consisting of Zener diode 27, a resistor 28 and a diode 20 is connected in parallel to primary winding 13*a* of ignition coil 12. Resistor 25 of the RC circuit consists of a number of individual resistors, one of which is a negative temperature coefficient resistor 25*a*. This resistor compensates for temperature variations which would otherwise occur in the threshold of thyristor 23. A discharge resistor 29 for capacitor 26 is connected in parallel to Zener diode 27. Further, damping resistor 24 of speed-dependent circuit 22 consists of a number of individual resistors which include a further negative temperature coefficient resistor 24*a*.

OPERATION

Figure 2:
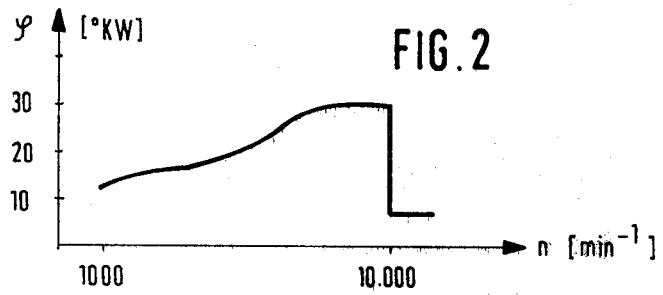
FIG. 2 is a characteristic curve of the ignition angle v. engine speed.
Figure 3:
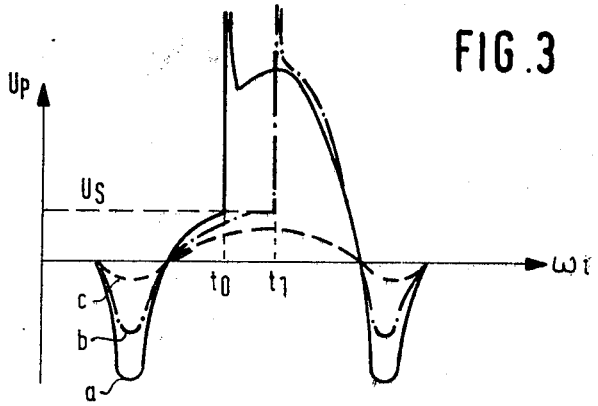
FIG. 3 illustrates the variation of primary voltage with respect to crank shaft angle before and after the start of operation of the speed limiting circuit of FIG. 1.

The operation of the ignition system will be explained with reference to FIGS. 2 and 3. FIG. 2 illustrates the variation of ignition angle as a function of speed for the internal combustion engine. The ignition angle is represented in angular degrees of crankshaft rotation prior to top dead center of the piston. At a no-load speed of approximately 1000 rpm, ignition takes place at an angle of approximately 12° prior to top dead center (TDC). Control circuit 19 now acts to increase this angle continuously for increasing speeds of the internal combustion engine to a maximum of 30° prior to top dead center in the direction of ignition advance. Line a of FIG. 3 shows the variation of primary voltage $U_p$ as a function of angle of rotation of magnet system 11 in the direction of the arrow at a speed of approximately 8000 rpm. At first, a negative voltage half wave occurs which is limited to approximately 10 volts by resistor 21. At the start of the positive voltage half wave in the primary circuit transistor 16 is driven to the conductive state via resistor 18 and a relatively high primary current starts to flow. The primary circuit is short circuited by transistor 16 and only a relatively small positive voltage half wave is applied to control circuit 19. Control circuit 19 is set for a particular threshold voltage $U_s$ and furnishes an output signal as soon as the primary voltage has reached this value (at time $t_o$). The base of transistor 16 is now connected to ground potential by control circuit 19, so that transistor 16 is immediately switched from the conductive to the blocked state. The primary current is interrupted and a high voltage pulse is induced in secondary winding 13*b*. A spark is generated by spark plug 15. Further, as illustrated in FIG. 3, the interruption of current in the primary circuit causes a voltage pulse of up to 300 volts to be generated in primary winding 13*a* at the ignition time. Thereafter, the shape of the positive half wave of primary voltage depends on the inductance of primary winding 13*a* resulting from the rotating magnetic system 11. A negative voltage half wave then follows the positive voltage half wave. The negative voltage half wave again is limited to approximately 10 volts by resistor 21.

The negative voltage half waves are also applied through resistor 28 to Zener diode 27. In the embodiment illustrated, the Zener voltage is 1.5 volts. The voltage applied to differentiating capacitor 26 is thus the negative voltage half wave limited to 1.5 volts. The slope of the leading edge of the negative voltage half wave determines the charging current for capacitor 26 and, therefore, the voltage pulse appearing across resistor 25. The latter is applied to the control circuit of thyristor 23. In the allowable speed range, the voltage pulse across resistor 25 has an amplitude less than the threshold voltage of thyristor 23 (i.e. less than 0.6 volts). Zener diode 27 also allows the system to operate independently of the air gap tolerances and inductive tolerances of magneto generator 10, i.e. different voltage amplitudes for the negative voltage half waves of different magneto generators will not affect the speed limiting action of the circuit.

If the speed of the internal combustion engine exceeds the maximum permissible speed, the leading edge of the first negative voltage half wave in the primary circuit, which is differentiated by capacitor 26 up to a voltage of 1.5 volts, creates a pulse across resistor 25 which is sufficient to ignite thyristor 23. Damping resistor 24 is thus connected in parallel to resistor 21, causing an increased loading of the negative voltage half wave. This variation of voltage is illustrated by the dot-dash line b in FIG. 3. The increased current flow during the negative half wave increases the armature reaction of magneto generator 10, thereby causing the subsequent positive current and voltage half wave to increase more slowly. The primary voltage reaches the threshold voltage of control circuit 19 at a later time, namely time $t_1$. The ignition timing is delayed by approximately 20° and the output power of the internal combustion engine is decreased until a further increase of speed is no longer possible. Since the threshold voltage $U_s$ of control circuit 19 varies with temperature, the damping of the negative voltage half wave in the primary circuit must also change as a function of temperature so that the ignition timing change when the maximum allowable speed is reached remains constant. Negative temperature coefficient resistor 24*a* is provided for this purpose.

The circuit illustrated in FIG. 1 may also be so designed that the negative voltage half waves in the primary circuit are so strongly damped when the speed of the engine exceeds the maximum allowable speed, that, for the following positive voltage half waves, the threshold voltage $U_s$ of control circuit 19 is no longer reached. This is illustrated by line c in FIG. 3. In this case, damping resistor 24 either has a very low resistance or is omitted altogether. Under these conditions, no further ignition takes place once the speed of the engine has exceeded the maximum permissible speed. Transistor 16 remains blocked during the whole positive half wave. Such speed limiting is provided when the engine is particularly sensitive to post-ignition or, as is the case in grinders, grinding wheels and other tools, there is acute danger if the speed of the tool is excessive.

Since the requirements for speed limiting of an internal combustion engine vary as a function of the use to which the ignition system is put, it may be possible to simplify the speed dependent circuit 23. For example, some of the individual resistors of the damping resistor 24 and resistor 25 may be omitted. Zener diode 27 may be replaced by a diode with opposite polarity or by a series circuit of a plurality of diodes. It should, however, be noted that the threshold voltage of thyristor 23 must be adjusted relative to the voltage limiting in the RC circuit 25, 26 so that the required control pulse for thyristor 23 is generated when the speed exceeds the maximum allowable speed.

Finally, the speed limiting according to the present invention may be used in ignition systems in which control circuit 19 intitiates ignition not in dependence upon the primary voltage but depending upon the primary current. It is important only that the ignition energy is supplied by a generator which generates a voltage half wave of opposite polarity prior to the voltage half wave in the primary circuit which is utilized for ignition. The voltage half wave not utilized for ignition is then so strongly damped by speed dependent circuit 22 when the speed of the motor exceeds the maximum permissible speed, that the subsequent voltage half wave is decreased by armature reaction of the magneto generator. Depending on the extent of damping of the previous half wave, this causes an instantaneous change of ignition timing in the direction of late ignition or a complete suppression of ignition by control circuit 19. Whether the positive or the negative voltage half wave are utilized for ignition is, of course, a matter of indifference and depends solely on the circuit design.

Various changes and modifications may be made within the scope of the inventive concepts.

We claim:

1. System for limiting the speed of an internal combustion engine having a magneto (10) including an armature, said armature forming an ignition coil (12) having a primary **(13*a*) and a secondary (13*b*) winding, a rotating magnet (11) for inducing an AC signal having a positive and negative half wave in said primary winding of said ignition coil, ignition switch means (16) connected in series with said primary winding of said ignition coil, ignition timing control means (19) connected across and responsive to voltage ($U_p$) across the primary winding, and controlling said ignition switch means for switching said ignition switch means from the conductive to the blocked state when a selected one of said half waves (e.g. positive) reaches a predetermined ignition amplitude ($U_S$), and damping circuit means (20, 21)** connected across said primary winding to draw damping current during occurrence of the other (then: negative) of said half waves, and speed dependent circuit means connected to said damping circuit means during occurrence of the other of said half waves drawing additional damping current and providing additional damping when said speed of said internal combustion engine exceeds a maximum allowable speed to delay rise in the voltage across the primary winding due to an increase in armature reaction resulting from said additional damping current and thus delay response of said ignition timing control means to the voltage ($U_p$) across the primary winding in the next subsequent one of said selected one of the half waves, thereby decreasing the speed of said internal combustion engine.

2. System as set forth in claim 1, wherein said speed dependent circuit means comprises at least switching circuit element (23) switched from a blocked to a conductive state in response to a speed limiting signal applied thereto, and differentiating circuit means (25,26) connected to said primary winding and said switching circuit element for furnishing said speed limiting signal to said speed dependent circuit element when the rate of change with respect to time of said other of said half waves exceeds a predetermined rate of change.

3. System as set forth in claim 2, wherein said switching circuit element is a thyristor.

4. System as set forth in claim 2, wherein said speed dependent circuit means further comprises damping resistance means (24) connected in series with said switching circuit element.

5. System as set forth in claim 4, wherein said damping resistance means comprises a plurality of damping resistors, at least one of said resistors being a negative temperature coefficient resistor.

6. System as set forth in claim 4, wherein said switching circuit element has a control circuit;

and wherein said differentiating circuit means comprises a series RC circuit having differentiating resistance means (25) connected in parallel with said control circuit.

7. A system as set forth in claim 6, wherein said differentiating resistance means comprises a plurality of differentiating resistors, at least one of said differentiating resistors being a negative temperature coefficient resistor.

8. A system as set forth in claim 2, further comprising voltage limiting means (27) connected in parallel to said differentiating circuit means.

* * * * *